United States Patent [19]

Mahnke

[11] 4,423,865

[45] Jan. 3, 1984

[54] EXERCISE BENCH

[75] Inventor: Parker E. Mahnke, Glendale, Calif.

[73] Assignee: Marcy Gymnasium Equipment Co., Alhambra, Calif.

[21] Appl. No.: 339,382

[22] Filed: Jan. 15, 1982

[51] Int. Cl.[3] ..... A01B 13/00

[52] U.S. Cl. ..... 272/123; 5/433; 297/377

[58] Field of Search ..... 272/122, 123, 146, 93, 272/117; 5/433, 68; 297/377

[56] References Cited

U.S. PATENT DOCUMENTS

| | | | |
|---|---|---|---|
| 1,175,260 | 3/1916 | Hartman | 5/433 |
| 2,563,671 | 8/1951 | Basinger | 5/433 |
| 3,353,196 | 11/1967 | Guillon | 5/433 |
| 4,302,009 | 11/1981 | Johnson | 272/123 |

OTHER PUBLICATIONS

Universal Exercise Equipment 1980–1981 Catalog of Universal, Cedar Rapids, Ia. p. 20 272/Catalog Digit Sporting Goods Dealer p. 102 Apr. 1981.

*Primary Examiner*—Richard J. Johnson
*Attorney, Agent, or Firm*—James E. Brunton

[57] ABSTRACT

An exercise bench for use in performing free weight exercises which includes interconnected first and second tubular frame members which cooperate to provide a base frame for the planar benches which support the trainee. The first frame member is substantially "U" shaped having transversely spaced apart upstanding legs which are interconnected by a rigid cross-member. The second centrally disposed frame member having at least one ground engaging support leg and a longitudinally extending support element disposed in a crossing relationship with the rigid cross-member of the first frame. This longitudinally extending support element supports the fixed and an adjustable planar bench portions which portions are hingeably interconnected together. The adjustable bench portion can be adjusted into several angular orientations with respect to the second frame member and can be locked into position by a unique, multipurpose stabilizing assembly which functions to rigidly connect together the first and second frame members and also to pivotally carry a bench support member adapted to locate and support the sloping, adjustable bench portion. The unique design of the stabilizing assembly provides substantial support to the unit against lateral and twisting forces impressed upon the device and at the same time functions to permit quick and positive adjustability of the slope of the adjustable portion of the bench.

5 Claims, 5 Drawing Figures

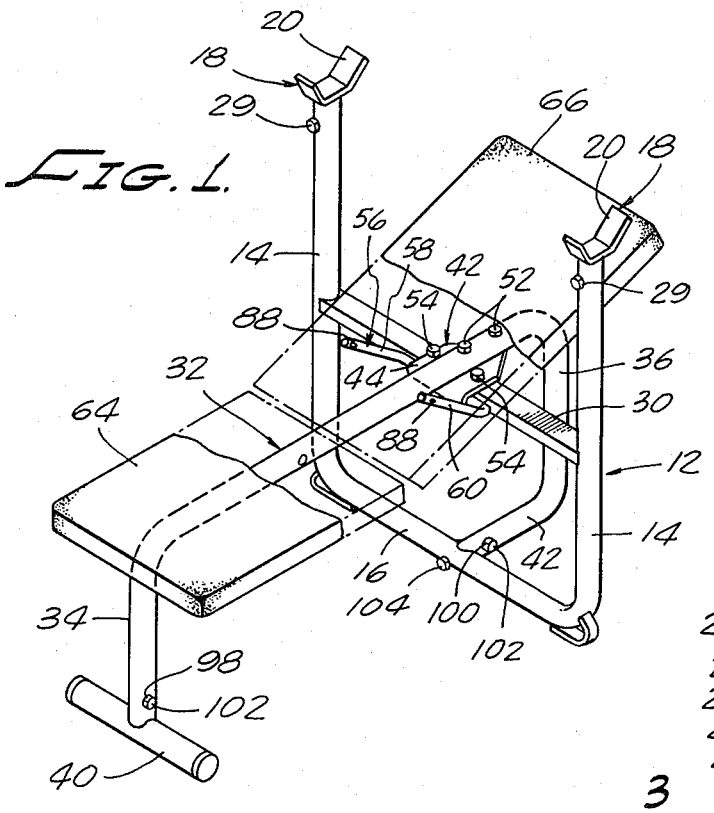
FIG. 1.
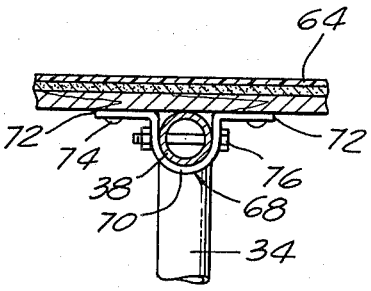
FIG. 4.
FIG. 2.
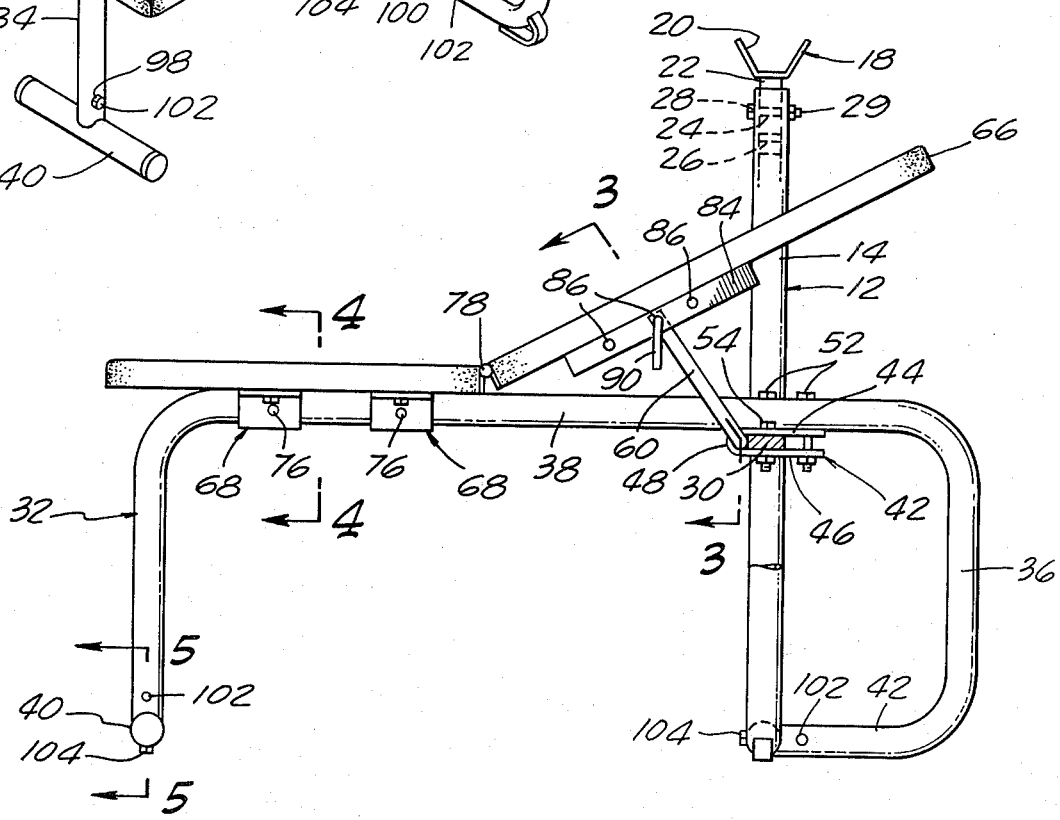
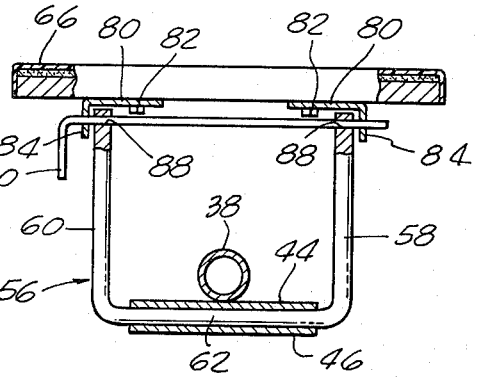
FIG. 3.
FIG. 5.
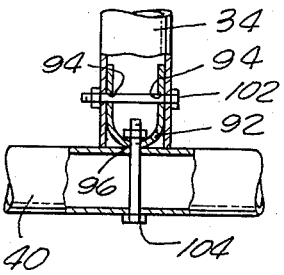

EXERCISE BENCH

BACKGROUND OF THE INVENTION

1. Field of the Invention

The present invention relates generally to body exercising equipment and more particularly to an exercise bench of the type used in the performance of free weight or barbell type exercises.

2. Discussion of the Prior Art

Various types of exercise benches have been manufactured in the past. Common to these types of devices is a pair of spaced apart vertical standards adaped to support the free weights when they are not in use and an interconnected supporting frame designed to support a planar bench upon which the trainee positions himself while lifting the weights from the supporting standards. The trainee may sit on the bench facing the weights or he may lie on the bench so that his upper body is positioned between the vertical standards and below the weights at rest thereon. In some prior art devices the bench is designed so that the forward portion thereof may be raised to a sloping position relative to the supporting frame. In such devices, the adjustable portion of the bench is usually supported in its sloping position by a rod extending between the weight supporting standards.

Because the gross weight which must be carried by the exercise bench is large, typically on the order of several hundred pounds, the supporting frame of the device must be very strong and highly stable. For example, the bench itself must support a trainee who often weights upwardly of 200 pounds and must also support the weights to be lifted by the trainee which may weigh upwardly of 300 pounds. Further, because of the various types of exercises to be performed, the device must be able to safely withstand substantial twisting and lateral type forces exerted on the supporting frame and upon the spaced apart weight supporting standards.

In order to meet the severe structural requirements placed upon exercise benches, the prior art benches typically embodied a rectangularly shaped base frame having four tubular legs which were rigidly interconnected by two spaced apart longitudinally extending side members and two transversely extending end members. The exercise board upon which the trainee was to lie rested upon the framework and was securely fastened to the side and end members thereof. To provide the required lateral and longitudinal stability, cross braces or heavy gussets were typically used to rigidly interconnect the legs and the side and end members of the framework. The upright standards which were adapted to support the free weights, usually in the form of a barbell, were then welded or otherwise affixed to the forward legs of the framework.

Exercise benches of the character described in the preceding paragraphs presented several drawbacks. In the first place they were usually very heavy, making the unit difficult to move, and they were also typically extremely expensive to fabricate and to ship. More importantly, benches of such design were frequently unstable and accordingly unsafe to use. Because the base frame was designed to support the bench proximate its edge portions, the limited width of the frame as well as the limited width, or lateral span, of the upright weight supporting standards was insufficient to provide adequate lateral stability. Accordingly, if the barbell was placed off center of the supporting standards, or if the trainee lifted or lowered the barbell unevenly, the bench had a tendency to tip sidewardly causing a substantial potential for severe injury to the trainee and to observers.

While others have suggested benches having crossing support frames such benches are typically of bulky welded construction and do not include the unique stabilizing and bench support mechanisms of the present invention.

The exercise bench of the present invention overcomes the drawbacks of the prior art benches in a highly novel manner. Rather than using the traditional four leg, rectangular bench construction, the unit of the present invention embodies a pair of uniquely formed crossing frames which are interconnected at their crossing point by a unique stabilizing assembly. The transverse frame member is generally "U" shaped in configuration having widely spaced apart upstanding legs which are adapted to support the barbell proximate their upper ends. The centrally disposed, longitudinally extending frame member functions to carry the fixed and adjustable planar bench portions of the unit upon which the trainee positions himself. The novel stabilizing mechanism serves the dual purpose of providing stability against lateral and twisitng forces impressed upon the supporting frame and at the same time functions to pivotally carry a pivotally movable support member adapted to support the adjustable bench portion in various upwardly sloping orientations.

The unique design of the device of the invention permits substantial weight savings without sacrificing strength. Because of the minimum number of component parts and the elimination of the need for cross braces, gussets and structural supports, the unit can be very inexpensively fabricated. Additionally, the unit is easy to assemble, readily movable from place to place and is highly safe and reliable in use.

SUMMARY OF THE INVENTION

It is an object of the present invention to provide a unique exercise bench for use in free weight exercises which includes a pair of crossing support frame assemblages adapted to rigidly support fixed and adjustable planar support benches. The frame assemblages are interconnected by a unique stabilizing mechanism which provides substantial lateral stability to the unit and at the same time permits rapid and positive adjustment of the slope of the adjustable planar support bench.

It is another object of the invention to provide an exercise bench of the aforementioned character which is lightweight, can be inexpensively manufactured by means of a process involving a minimum number of manufacturing steps and requiring a minimum number of manufacturing jigs and fixtures.

It is still another object of the invention to provide an exercise bench of the character described which includes a minimum number of interconnected components so that it is easy to assemble, but yet is extremely sturdy, reliable and safe in use.

More particularly, it is an object of the invention to provide a unit of the class described which includes widely spaced apart weight supporting uprights which are highly stable and which permit the use of relatively large amounts of weights without fear of twisting or tipping of the weight supporting uprights.

It is a further object of the invention to provide an exercise bench of the type described in the preceeding paragraphs which includes a minimum number of structural braces, gussets, and reinforcing members to provide stability in the unit.

It is still another object of the invention to provide an exercise bench of the character described which is highly versatile in use and can readily be adjusted into multiple positions to enable the safe performance of numerous exercises using weights weighing several hundred pounds.

BRIEF DESCRIPTION OF THE DRAWINGS

FIG. 1 is a perspective view of the exercise bench of the present invention. The view is partly broken away to show construction of the base frame and of the stabilizing mechanism of the invention.

FIG. 2 is a side elevational view of the exercise bench of the invention.

FIG. 3 is a cross-sectional view taken along lines 3—3 of FIG. 2 showing the construction of the stabilizer mechanism of the invention.

FIG. 4 is a cross-sectional view taken along lines 4—4 of FIG. 2.

FIG. 5 is a cross-sectional view taken along lines 5—5 of FIG. 2.

DESCRIPTION OF ONE FORM OF THE INVENTION

Referring particularly to FIGS. 1 and 2 of the drawings, the exercise bench of the present invention includes a supporting, or base, frame comprising a first "U" shaped frame member 12 having a pair of transversely spaced apart upstanding tubular legs 14 interconnected by a bight portion 16. Provided at the upper extremity of each leg 14 is a vertically adjustable barbell supporting cradle assembly 18.

As best seen by referring to FIG. 2, each weight supporting cradle assembly 18 comprises a generally "U" shaped cradle member 20 and a downwardly extending tubular member 22 affixed thereto and adapted to be telescopically received within the open upper end of each of the legs 14. Portion 22 is apertured at vertically spaced apart locations 24 and 26. Each leg 14 is also apertured proximate its upper extremity. By telescopically moving the weight supporting cradle 20 upwardly and downwardly within the tubular leg portions 14, the apertures in the downwardly extending member 22 can be aligned with the aperture 28 in each of the legs so that an elongated bolt 29 may be inserted through the apertures in the legs so that an elongated bolt 28 may be inserted through the apertures in the legs and in the depending member 22. In this way, weight cradle can be positioned at pre-determined vertical heights relative to the top of the legs 14.

Referring again to FIG. 1, a rigid cross-member 30 is disposed above the bight portion 16 of the first frame member and is fixedly connected to each leg 14 proximate its mid point.

Also comprising a part of the supporting frame of this embodiment of the invention is a second frame member generally designated in the drawings by the numeral 32. This second frame member includes a pair of spaced apart downwardly extending leg portions 34 and 36 which are integrally formed with a longitudinally extending support member 38. Longitudinal member 38 is located in a crossing, generally perpendicular relationship with respect to the rigid cross member 30 of the first frame member. Affixed to the lower end of leg portion 34 is a transversely extending stabilizing member 40 which forms a part of the floor engaging means of the invention. As will presently be described, member 40 is interconnected with leg 34 by a novel interconnection mechanism illustrated in FIG. 5. Also comprising a part of the floor engaging means of the invention is a longitudinally extending stabilizing member 42 which is integrally formed with leg 36 of the second frame member. The free end of member 42 is connected to the bight portion 16 of the first frame by an assemblage similar to that illustrated in FIG. 5.

Comprising an important aspect of the present invention is a stabilizing means which functions to rigidly interconnect cross member 30 and the longitudinally extending portion 38 of the first frame member. This uniquely designed stabilizing means performs the dual function of providing remarkable stability to the supporting frame and at the same time serves to adjustably support the sloping planar portion of the bench of the apparatus in a positive and novel manner. In the form of the invention shown in the drawings, the stabilizing means comprises a transversely extending cross-sectionally "U" shaped stabilizing plate 42 having vertically spaced apart upper and lower walls 44 and 46 (FIG. 2) defining at their junction an elongated transversely extending bearing surface 48. As best seen by referring to FIG. 2, stabilizing plate 42 is connected to longitudinally extending member 38 by two longitudinally spaced apart fasteners, or bolts, 52 which extend through longitudinal frame portion 38 and then through the upper and lower walls 44 an 46 of the stabilizing plate. Stabilizing plate 42 is also securely connected to cross member 30 by two transversely spaced apart fasteners in the form of bolts 54 which extend through upper plate 44, through cross member 30 and then through lower plate 46. With this unique construction, the first and second frame members are rigidly interconnected in a manner so as to resist forces impressed upon the structure tending to twist the first and second frame members relative to each other. Additionally, the stabilizing plate 42 effectively functions to resist lateral forces impressed upon the structure tending to separate the frame members.

Also forming a part of the important stabilizing means of the invention is a "U" shaped supporting element 56 having spaced apart legs 58 and 60 and an interconnecting bight portion 62 (FIG. 3). Portion 62 of element 56 is rotatably carried within elongated transverse bearing 48 defined by the bight portion of the stabilizing plate 42. In a manner presently to be described, with this construction, legs 58 and 60 of member 56 may be pivotally elevated and lowered into various positions to engageably support the sloping portion of the planar bench.

In the embodiment of the invention shown in the drawings, the planar bench which supports the trainee during the performance of exercises, comprises a fixed portion 64 and an adjustable or upwardly sloping forward portion 66. Fixed portion 64 is rigidly affixed to longitudinally extending member 38 by means of fasteners 68 of the character shown in FIGS. 2 and 4. As illustrated in FIG. 4, each of these fasteners 68 comprises a curved body portion 70 adapted to encircle longitudinally extending member 38 and integrally formed outwardly extending flange portions 72 adapted to be affixed to the underside of planar board 64 by means of appropriate fasteners 74. Body portion 70 of each fastener is in turn rigidly interconnected with the longitudinal portion 38 of the second frame member by means of fasteners such as elongated bolts 76 which extend through body portion 70 as well as through the walls of portion 38.

The second, adjustable planar bench portion 66 of the planar bench is hingeably connected with the first portion 64 by means of an elongated piano-type hinge 78 (FIG. 2). With this arrangement bench portion 66 can be pivotally adjusted into various sloping configurations with respect to the supporting frame of the apparatus.

Referring now to FIGS. 2 and 3, the invention in the form there shown includes interconnecting means adapted to be secured to the underside of second bench portion 66 for releasable interconnection with the upper free ends of legs 58 and 60 of "U" shaped member 56 when the sloping bench portion is disposed in various elevated positions with respect to the base frame. As best seen in FIG. 3, the interconnecting means of this embodiment of the invention comprises two "L" shaped brackets 80 which are securely affixed by means of appropriate fasteners 82 to the lower surface of planar bench portion 66. Each of the brackets 80 include transversely spaced apart downwardly depending side walls 84 which are provided with a plurality of longitudinally spaced apart apertures 86 therethrough (FIG. 2). As shown in FIG. 3, legs 58 and 60 of supporting element 56 are also apertured proximate their upper ends at the locations indicated by the numeral 88. By rotating support element 56 within bearing 48 and by appropriately elevating the bench portion 66, apertures 88 in the leg portions of the supporting element can be aligned with the desired set of apertures 86 formed in the side walls of the channel shaped brackets 80. When the apertures are thusly aligned, an elongated locking pin 90 (FIG. 3) can be inserted through the aligned apertures so as to rigidly support bench portion 66 in the desired upwardly sloping orientation. The degree of slope of bench portion 66 can be varied by removing pin 90, lowering or raising bench portion 66 to realign the apertures in legs 56 and 60 with an alternate set of apertures 86 provided in the sidewalls of the channel bracket, and then reinserting pin 90 to lock the bench in the selected position.

It is to be noted that due to the substantial length of the bearing portion 48 formed in the stabilizing plate and the widely spaced apart legs 58 and 60 of the supporting element 56, when the supporting element is interconnected with the channel shaped bracket 80 in the manner just described, the upper portion 66 of the exercise bench is rigidly supported against forces tending to twist the upper portion of the bench relative to the lower portion of the bench. This unique construction effectively stabilizes the apparatus against tipping from side to side.

Turning now to FIG. 5, there is illustrated the unique fastening mechanism adapted to rigidly interconnect portions 34 and 42 of the second frame member with members 16 and 40. This assembly includes a member 92 which is "U" shaped in cross-section and is of a size to be closely telescopically received within the open ends of portions 34 and 42. The side walls of member 92 are apertured at 94 and an aperture 96 is also formed in the bight portion of member 92. As best seen by referring to FIG. 2, portions 34 and 42 of the second frame are apertured at locations 98 and 100 respectively which are adapted to be aligned with apertures 94 formed in "U" shaped member 92 when said members are in position within the open ends of portions 34 and 42. Similarly, elements 40 and 16 are apertured at a location to align with apertures 96 formed in the bight portion of member 92. With member 92 telescopically received within portions 34 and 42 of the frame members and with the apertures in the members aligned in the manner discussed, fasteners such as bolts 102 and 104 can be inserted through the aligned apertures to effectively interlock the members together in the manner shown in FIG. 5.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An exercise bench comprising:

(a) a supporting frame, including:

(1) a first "U" shaped frame member having a pair of transversely spaced apart upstanding legs interconnected by a bight portion;

(2) a rigid cross-member disposed above said bight portion of said first frame member and interconnecting said legs thereof;

(3) a second frame member having at least one downwardly extending leg and a longitudinally extending portion, said longitudinally extending portion being disposed in a crossing relationship with respect to said rigid cross-member;

(4) floor engaging means connected to said leg of said second frame member proximate the lower end thereof for providing stability to said frame member;

(5) a transversely extending cross-sectionally "U" shaped stabilizing plate having vertically spaced apart upper and lower walls defining an elongated transversely extending bearing surface therebetween, said upper wall being rigidly connected to said longitudinally extending portion of said second frame member and said lower surface being rigidly connected to said rigid cross-member;

(6) a supporting element having upstanding legs interconnected proximate one end thereof with a transversely extending portion, said portion being received with in said transversely extending bearing surface of said connecting plate for rotational movement therewithin;

(b) a first planar, bench portion extending longitudinally of said support member of said second frame member and rigidly connected thereto;

(c) a second planar bench portion hingeably interconnected with said first bench portion for pivotal movement relative thereto into various elevated positions through an acute angle with respect to said support member of said second frame member; and (d) an interconnecting means carried by said second bench portion including spaced apart portions adapted to be releasably interconnected with said free ends of said upstanding legs of said supporting element and said second planar bench portion when said portion is disposed in various angular positions with respect to said support member of said second frame member.

2. An exercise bench as defined in claim 1 which includes first and second downwardly extending leg portions interconnected proximate their upper ends by said longitudinally extending portion and in which said floor engaging means comprises:

(a) a transversely extending stabilizing member affixed to the lower end of one of said first and second legs of said second frame member; and (b) a longitudinally extending stabilizing member affixed at one end to said bight portion of said first "U" shaped frame and at its opposite end to the lower end of the other of said first and second legs of said second frame member.

3. An exercise bench including a supporting frame comprising:

(a) a first frame assemblage having a pair of spaced apart, upstanding legs and a rigid cross-member interconnecting said legs at locations intermediate their ends;

(b) a second frame assemblage having at least one downwardly extending leg and an interconnected longitudinally extending support member disposed in a crossing, substantially perpendicular relationship with said rigid cross-member of said first frame member; and (c) stabilizing means rigidly interconnecting said rigid cross-member and said longitudinally extending support member proximate the crossing point of said members for providing lateral stability to the exercise bench, said stabilizing means comprising a transversely extending stabilizing plate substantially "U" shaped in cross-section at any point and having vertically spaced apart upper and lower transversely extending walls defining a transversely extending bearing therebetween and an adjustable bench supporting means pivotally carried by said bearing.

4. An exercise bench including a supporting frame comprising:

(a) a first frame assemblage having a pair of spaced apart, upstanding legs and a rigid cross-member interconnecting said legs at locations intermediate their ends;

(b) a second frame assemblage having at least one downwardly extending leg and an interconnected longitudinally extending support member disposed in a crossing, substantially perpendicular relationship with said rigid cross-member of said first frame member; and (c) stabilizing means rigidly interconnecting said rigid cross-member and said longitudinally extending support member proximate the crossing point of said members for providing lateral stability to the exercise bench, said stabilizing means including an elongated, transversely extending bearing means and an adjustable bench supporting means pivotally associated with said bearing means, said stabilizing means being affixed to said longitudinally extending support member of said second frame assemblage at at least two longitudinally spaced apart locations and also being affixed to said cross-member of said first frame assemblage at at least two transversely spaced apart locations disposed on opposite sides of said longitudinally extending support member of said second frame assemblage.

5. An exercise bench including a supporting frame comprising:

(a) a first frame assemblage having a pair of spaced apart, upstanding legs and a rigid cross-member interconnecting said legs at locations intermediate their ends;

(b) a second frame assemblage having at least one downwardly extending leg and an interconnected longitudinally extending support member disposed in a crossing, substantially perpendicular relationship with said rigid cross-member of said first frame member;

(c) stabilizing means rigidly interconnecting said rigid cross-member and said longitudinally extending support member proximate the crossing point of said members for providing lateral stability to the exercise bench, said stabilizing means including an elongated, transversely extending bearing means and as adjustable bench supporting means pivotally associated with said bearing means, said adjustable bench supporting means comprising spaced apart upstanding legs interconnecting a bight portion pivotally receivable within said bearing means said legs having transversely extending apertures formed therein proximate the upper ends thereof;

(d) a first planar bench portion interconnected with and extending longitudinally of said support member of said second frame assemblage;

(e) a second planar bench portion carried by said support frame and adapted for pivotal movement relative to said first bench portion into various elevated positions with respect to said support member of said second frame assemblage; and (f) interconnecting means carried by said second bench portion for releasably interconnecting said free ends of said upstanding legs of said bench supporting means with said second bench portion when said latter portion is disposed in various elevated positions with respect to said support member of said second frame assemblage, said interconnecting means comprising:

(i) spaced apart "L" shaped brackets affixed to the underside of said second bench portion, each of said brackets having downwardly depending side walls provided with a plurality of apertures formed therethrough; and (ii) an elongated locking pin adapted to be removably inserted into the apertures formed in said legs of said bench supporting means and into the apertures formed in the sidewalls of said brackets whereby said bench supporting means and said brackets can bereleasably interconnected.

* * * * *